US005724787A

United States Patent [19]

Diete

[11] Patent Number: 5,724,787

[45] Date of Patent: Mar. 10, 1998

[54] APPARATUS FOR THE PRODUCTION OF PACKAGES

[75] Inventor: Günter Diete, Obergünzburg, Germany

[73] Assignee: Firma Dixie-Union GmbH & Co. KG, Kempten, Germany

[21] Appl. No.: 711,266

[22] Filed: Sep. 9, 1996

[30] Foreign Application Priority Data

Sep. 9, 1995 [DE] Germany ..... 295 14 511 U
Feb. 24, 1996 [DE] Germany ..... 296 03 395 U

[51] Int. Cl.[6] ..... B65B 63/04

[52] U.S. Cl. ..... 53/119; 53/118; 53/514; 53/517

[58] Field of Search ..... 53/118, 119, 514, 53/515, 516, 517, 518, 519; 99/537; 426/392, 501, 518

[56] References Cited

U.S. PATENT DOCUMENTS

| | | | |
|---|---|---|---|
| 486,090 | 11/1892 | Crowell | 53/119 X |
| 593,959 | 11/1897 | Clark | 53/119 |
| 1,047,422 | 12/1912 | Loewy | 53/119 X |
| 2,620,609 | 12/1952 | Pope | 53/119 X |
| 2,746,403 | 5/1956 | Hansen | 426/501 |
| 3,225,717 | 12/1965 | Page | 426/501 X |
| 3,458,970 | 8/1969 | Reid et al. | 53/118 X |
| 3,735,694 | 5/1973 | Richards et al. | 99/450.1 |
| 4,276,317 | 6/1981 | Hayashi | 426/501 |
| 5,205,106 | 4/1993 | Zimmermann et al. | 53/118 |

*Primary Examiner*—Daniel Moon

*Attorney, Agent, or Firm*—Jacobson, Price, Holman & Stern, PLLC

[57] ABSTRACT

The invention relates to an apparatus for producing packages containing sliced food products, in which the slices are rolled up into individual rolls by a rolling facility and deposited in a package.

8 Claims, 5 Drawing Sheets

Figure 1:
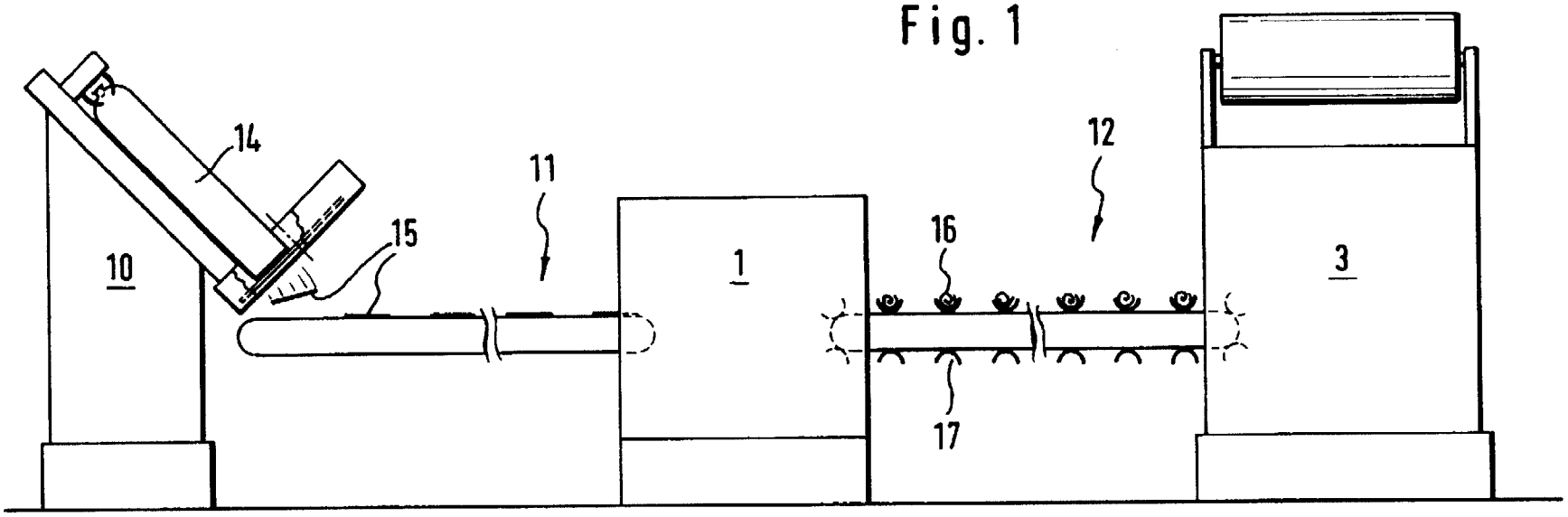

2
11
12
15
16
17
20
21
22
23
24
25
26
27
28
29
30
35
IV
V

APPARATUS FOR THE PRODUCTION OF PACKAGES

The present invention relates to an apparatus for the production of packages more particularly of sliced food products or the like.

It is known to cut up sausage or other food products, such as for example bacon, ham, cheese or the like, into slices by means of high-speed machines. The sliced product is then conveyed, subsequently, to a packaging machine in stacks of a specific weight or number of slices, where the stacks are packaged. A packaging machine of this type is designed, for example, as a vacuum packaging machine and forms the packages from a bottom sheet and a top sheet. Troughlike depressions, for example, are molded into the bottom sheet and, after filling with the product to be packaged, are covered by a top sheet. Following evacuation, the top sheet is sealed onto the bottom sheet.

It is known also, in the production of packages of this type, to arrange the sliced product in imbricated or overlapping fashion. An imbricated package has the advantage that the individual slices are visible and create a more attractive appearance. The imbrication may be in one direction, in particular in the conveying direction of the slices following the slicing operation. Imbrication in two directions is also possible, however, in which case a comparatively large-area arrangement of the sliced product is needed.

Both in the packaging of stacks and in the case of imbrication, there is the problem that the individual slices stick to one another and it is often difficult to separate the slices from one another on consumption. This applies in particular in the case of products which are cut into very thin slices. Improved separation of the individual slices can be achieved if paper sheets or sheets of plastic foil are inserted between the slices. Apart from the fact that the insertion of paper sheets requires additional expenditure, the insertion of such intermediate sheets is often undesirable.

It is the object of the invention to improve an apparatus of the generic type specified at the outset such that packages are obtained which have a very attractive outward appearance and in particular allow easy separation of the individual slices.

In order to achieve this object the invention provides an apparatus which comprises a slicing machine which continuously cuts the product, which is to be sliced, into slices which the slicing machine successively lays onto a conveying facility which conveys the slices to a rolling facility, the rolling facility forming the slices into individual rolls by means of a rolling operation and the rolls arriving in a package, at least some adjacent to one another, downstream of the rolling facility.

The rolling of the individual slices has the result that each slice is separately visible in the finished package, in its full size. In addition, it is possible to take individual rolls from the package without touching and also without damaging the other rolls. This applies in particular when all the rolls are arranged adjacent to one another in the package. A similar result can also be achieved, however, by stacking some of the individual rolls one upon the other in the package, although as a rule this is less preferable.

A rolling facility for the invention may, for example, be fashioned in such a way that at least one rotationally driven rolling mandrel is provided which grasps the leading edge of the slices. The cooperation of the rolling mandrel with the leading edge of the slices may be ensured, for example, by using a slotted mandrel and introducing the leading edge of the slices into a respective mandrel slot. In another embodiment, a securing means is provided on the mandrel for fixing the leading edge of the slices.

It is advantageous to arrange a plurality of mandrels on a rotating device. This arrangement allows the mandrels to be moved from a receiving position into a delivering position, in which the finished rolls are discharged again. A further advantage which is obtained is that the period of time available for the rolling operation can be increased considerably.

The discharging of the rolls from the rolling facility may be effected in particular by a stripping device engaging on the mandrel and stripping the formed roll from the mandrel during an axial relative movement of the stripping device with respect to the mandrel. After the stripping, the roll arrives, for example, in troughs of a further conveying facility which conveys the rolls to the packaging machine for example.

In a preferred embodiment of the invention, the rolling mandrel comprises parallel bars which are each held at one end by a support, the support and the bars being rotatable about an axis, at least some of the bars being the same distance from the axis and the sliced food products being insertable, generally radially to the axis, between two neighbouring bars.

It has been found that the rolling operation works well with a rolling apparatus designed according to the invention. This applies both to slices of small thickness and to slices of somewhat greater thickness. In particular, there is sufficient space between two bars to be able to insert the slices to be rolled, and this even when the slices have small deformations for whatever reasons.

The rolling mandrel is preferably formed from four bars which are spaced equidistantly from one another. Such an arrangement provides the possibility of being able to insert the slices in four different positions of the rolling apparatus, thereby improving the efficiency of the apparatus.

For the conveyance of the slices to the rolling apparatus, a conveying apparatus is provided, preferably an endless circulating conveying means having bands, belts or the like. Between the delivering end of the conveying apparatus and the bars of the rolling apparatus there is provided a slideway supporting the slices. It emerged that, as a rule, a small gap between the delivering end of the conveying apparatus and the bars is unavoidable, since space must be left for the formation of the roll. With thin slices, however, there is the risk of them sticking to the conveying means and not arriving between the bars. This is prevented by the above-mentioned slideway.

The slideway may be designed in various ways. In particular, the slideway may be movably arranged. In this regard, it is possible to construct the slideway to be advanceable in the conveying direction and withdrawable, so that the slideway is effective substantially only at the moment of insertion of the slices into the interspaces between the bars. When the slideway is being withdrawn, the roll can be formed. The provision of a resilient slideway is also possible, the latter then being pushed away each time by the bars during the rolling operation. The slideway may, in particular, rest on the bars, thus ensuring that even thin slices reach the desired position between the bars.

The invention further proposes a holding-down device which, during the rolling operation, presses the slice against the bars rotating about the axis. A holding-down device of this type ensures sufficient density of the roll, which retains its shape even during transfer to the package and while in the package. It is clear that the cohesion of the roll is possibly also assisted by the adhesion of the surfaces of the slice to one another.

In particular, the invention provides that the slices be insertable between the bars of the rolling apparatus in such a way that, during the rolling movement, the slice is taken along by at least two bars.

After formation, the roll has to be removed from the bars. This may be effected in various ways. For example, the roll may be pushed off or pulled off in the axial direction of the slices. It is better, however, if the bars are displaceable in the direction of the rolling axis, in which case the rolls remain behind in particular under the action of a stripper and are freed from the rolling apparatus. In this way, the rolls are moved very little, which is advantageous in view of the sensitive product and the low strength. Where appropriate, it is possible to do without a stripper, namely when the displacement movement of the bars takes place rapidly enough for the bars not to be able to take along the rolls.

It is advantageous for the rolling apparatus to place the rolls into the package. In this regard, provision may be made, for example, for the package to be arranged directly below the rolling apparatus so that the rolls drop into the package or into the troughs provided therein. The provision of transfer facilities is also possible and is likewise part of the invention.

Figure 2:
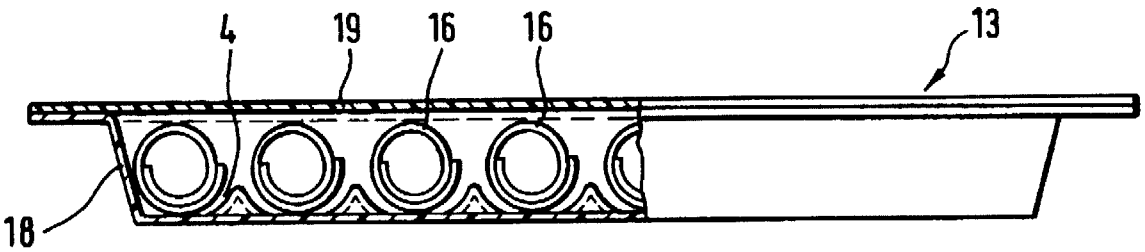
Figures 3, 4, 5:
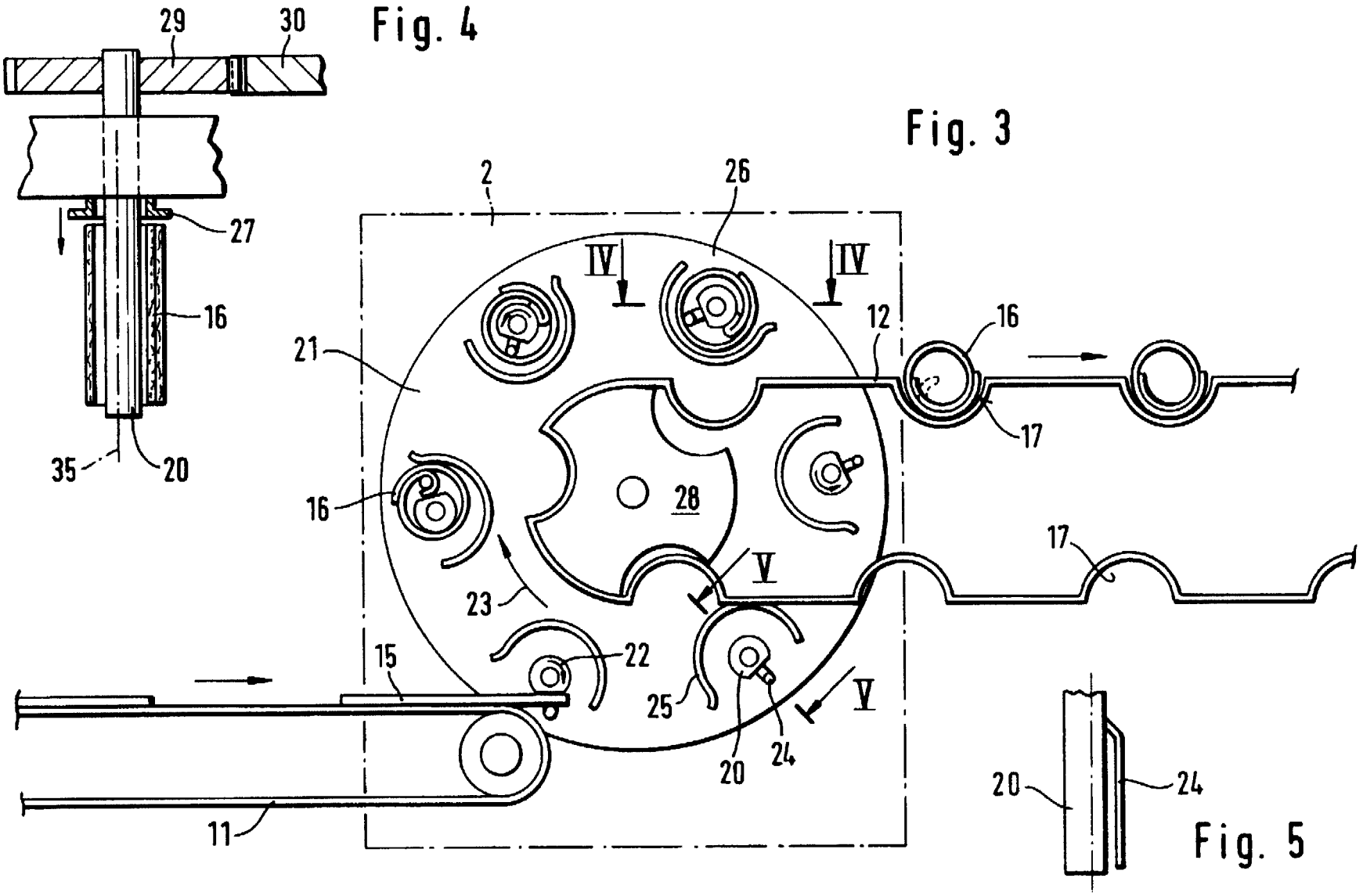
Figure 6:
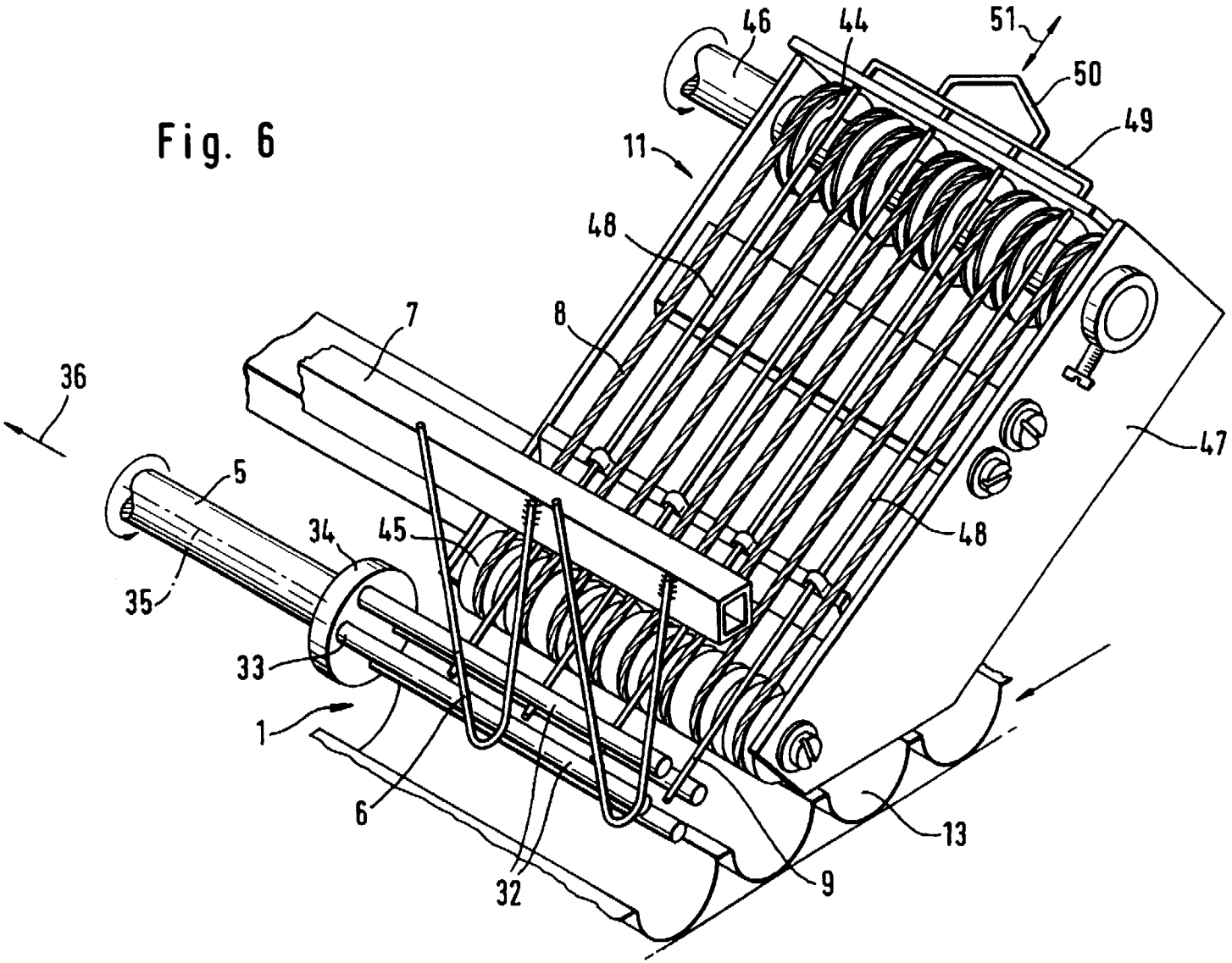
Figure 7:
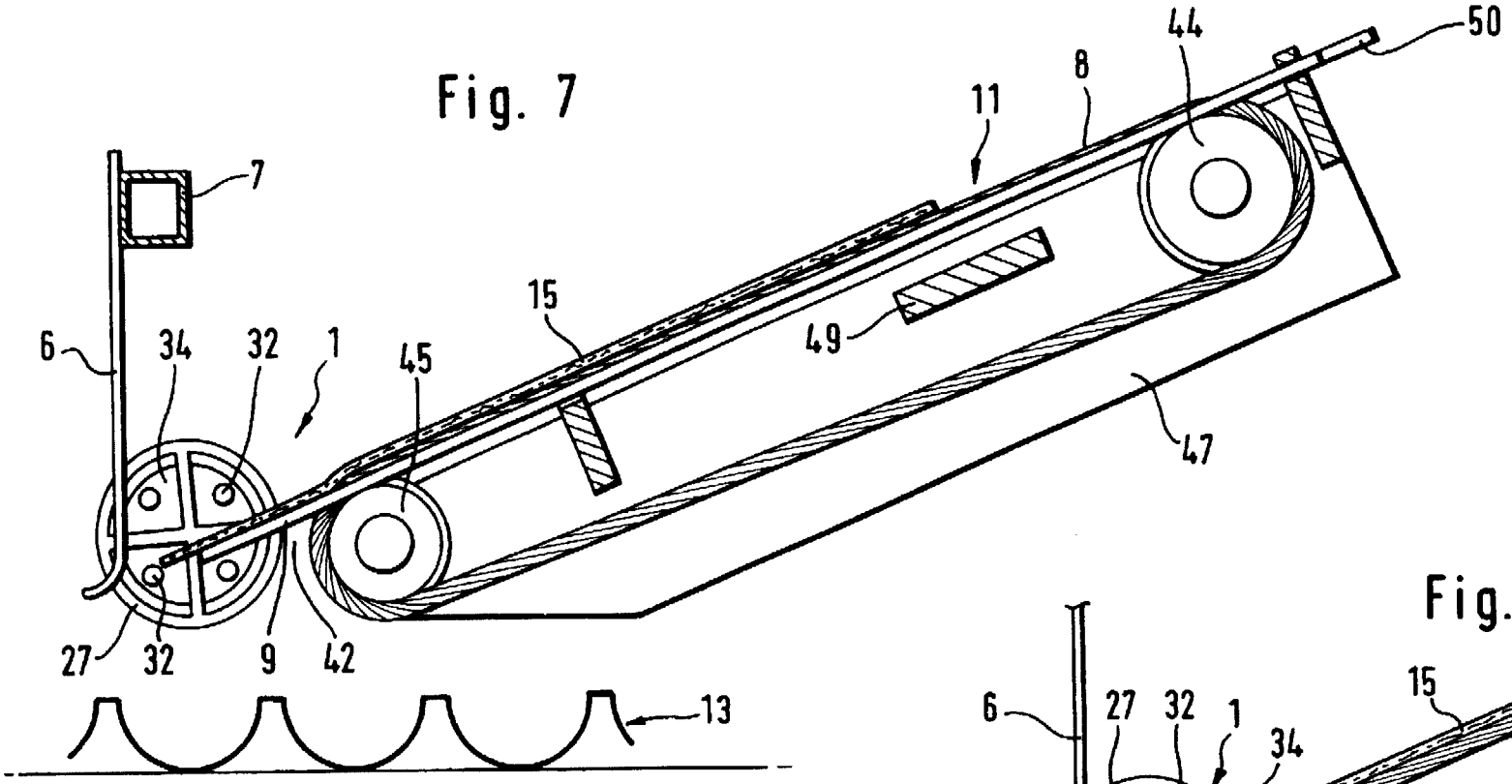
Figure 8:
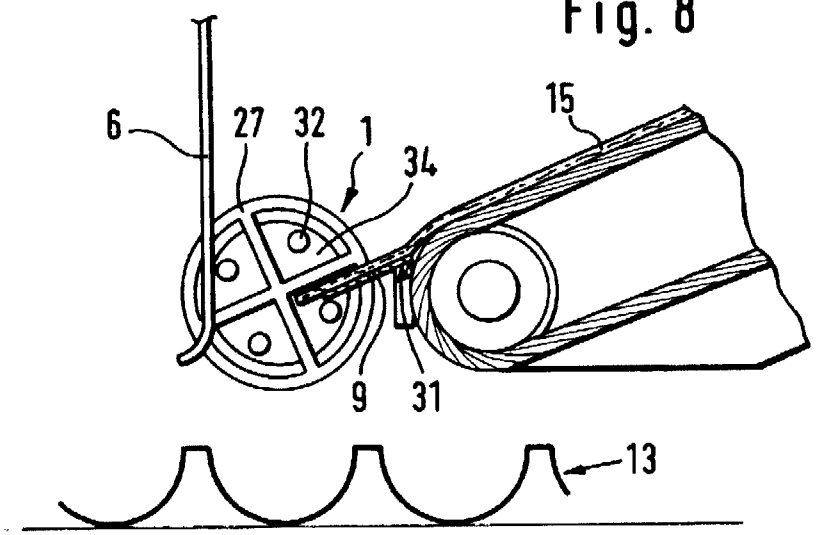
Figure 9:
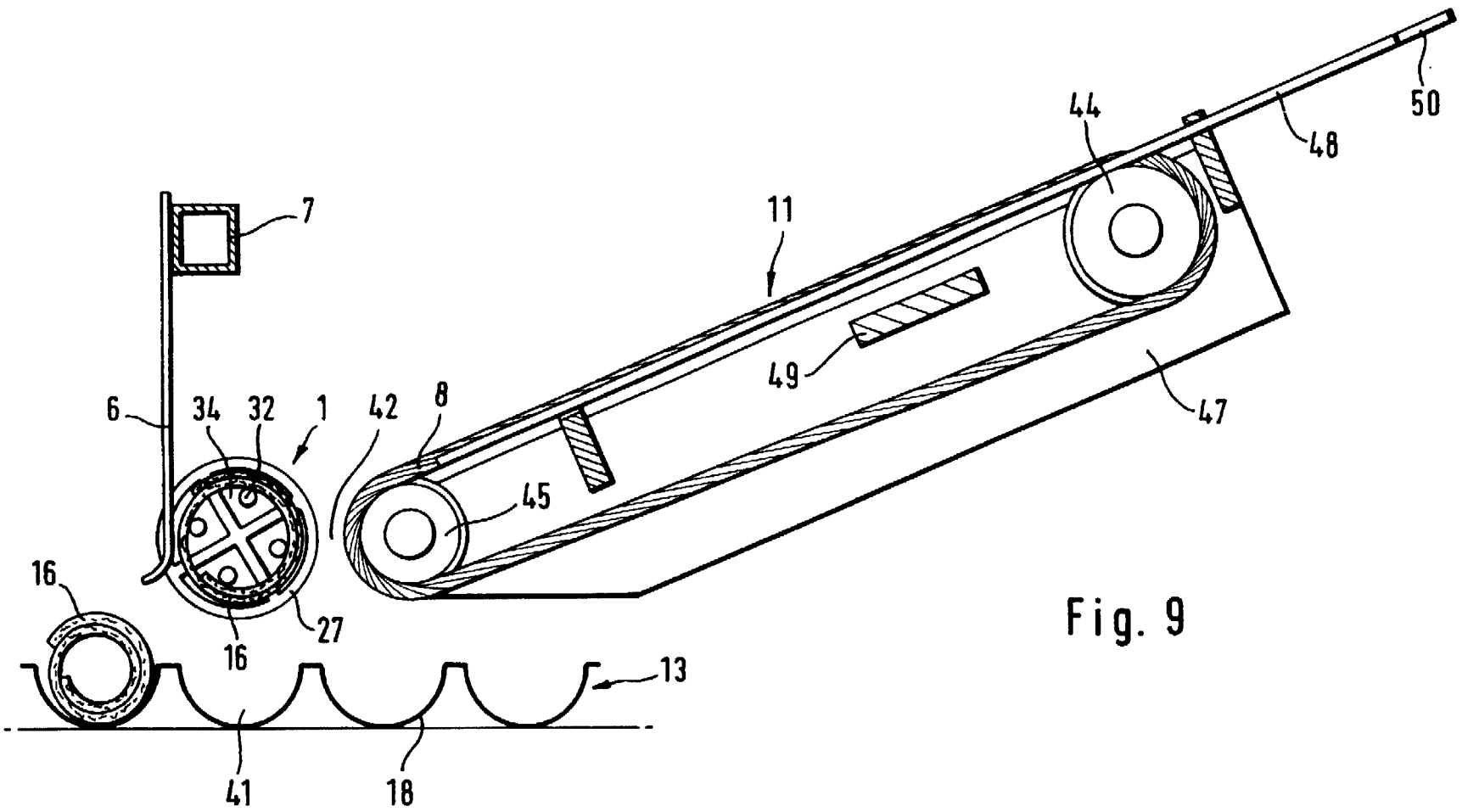

The invention will now be described further by way of example with reference to the accompanying drawings in which:

FIG. 1 is a side view of an apparatus according to the invention for the production of packages, FIG. 2 is a side view, partially in section, of a package on a larger scale, FIG. 3 is a side view of a rolling facility, FIG. 4 is a section through the representation of FIG. 3 along the section line IV—IV, FIG. 5 is a section through the representation of FIG. 3 along the section line V—V, FIG. 6 is a perspective representation of a modified embodiment of an apparatus according to the invention, FIG. 7 is a side view of the representation of FIG. 6 in one operating position, FIG. 8 is a modified exemplary embodiment with regard to the representation of FIGS. 6 and 7, and FIG. 9 is a representation corresponding to FIG. 7, but in another operation position.

The apparatus shown in FIG. 1 consists essentially of a slicing machine 10, a conveying facility 11, a rolling facility 1, a further conveying facility 12 and a packaging machine 3.

The slicing machine 10 cuts off individual slices 15 from a product to be sliced 14, which slices drop onto the conveying facility 11. This conveying facility is depicted, in the exemplary embodiment shown, as a conveyor belt. However, provision may also be made for a different conveying facility, for example a transporting plate or similar device.

Downstream of the rolling facility 1, which will be described in greater detail below, the rolls 16 produced there arrive on the conveying facility 12, which preferably possesses pockets or troughs 17 adapted to the size of the individual rolls 16.

The conveying facility 12 is likewise depicted, in the exemplary embodiment shown, as a conveyor belt. Here, too, different conveying means may be used, if this is desired.

The rolls 16 in the troughs 17 are conveyed to the packaging machine 3 and packaged there in a manner known per se. The introduction of the rolls 16 into the packaging machine may be carried out automatically, but it is also possible to supply the rolls manually to the packaging machine.

The packaging machine 3 fabricates, as known per se, packages 13, to be placed on a tray or dish 18 which is closed by a sealed-on cover 19. The dish receives the rolls 16 one beside the other. It is also possible to mold troughlike depressions 4 into the dish 18.

FIGS. 3, 4 and 5 illustrate a rolling facility 2, in which the individual slices of product are each rolled up on a rolling mandrel 20. Mounted on the rotating device 21 are a total of six mandrels 20 which are each independently rotatable. The rotating direction of the mandrels 20 is indicated by the arrow 22, the rotating direction of the rotating device by the arrow 23. In order to obtain the rotary movement of the mandrels 20 about the axis 35, the mandrels 20 carry, for example, a toothed wheel 29 which moves on rolling contact on the stationary toothed ring 30. The mandrel 20 may, if desired, also be driven in the opposite direction. Each mandrel is equipped with a bow 24, as shown in FIG. 5. The front end of the slice 15 being conveyed up to the rolling facility on the conveying facility 11 is inserted into the gap between the bow 24 and the mandrel 20. The mandrel 20 is, furthermore, surrounded by a container 25 in the form of part of a cylinder, which facilitates the rolling-up operation.

The orientation of the feed-conveying direction of the slices 15 with respect to the mandrels 20 or the orientation of the mandrels 20 with respect to the support 21 may also be angular, in order to obtain helical rolls 16.

When the respective rolling mandrel has reached a position which is marked by the reference numeral 26, the stripping device 27 comes into operation (cf. FIG. 4) and strips the formed roll from the mandrel 20, so that said roll arrives in one of the troughs 17 of the conveying facility 12. The circulating roller 28 of the conveying facility 12 is arranged coaxially with the rotating device 21.

The apparatus shown in FIG. 6 consists essentially of the conveying facility 11 and the rolling facility 1. The conveying facility 11 includes an endless conveying means comprising two roller arrangements 44, 45, which guide cords or bands 8. In this arrangement, the rear roller arrangement 44, for example, may be driven via the shaft 46. The frame of the conveying apparatus is denoted by 47. Mounted in the frame 47, furthermore, are a number of rods 48, the rear ends of which are interconnected by a crossmember 49. An eyelet or hook 50, upon which a drive (not shown) acts, is placed on the crossmember 49. The drive may impose upon the rods a reciprocal movement in accordance with the double-headed arrow 51.

The front ends of the rods 48 together form a slideway 9. When the slideway 9 is pushed forward, the ends of the rods project into the interspaces between the bars 32 of the rolling apparatus, as is apparent in particular from the representation of FIG. 7. This prevents the slices 15 which are being conveyed up to the rolling facility by the bands 8 from sinking into the gap 42. The slices 15 in this way safely reach the space between the bars 32. The feed-conveyance of the slices 15 should be continued until the bars 32 in the rolling operation, securely grasp the beginning of the slices and form the roll.

As is apparent in particular from FIG. 6, the ends 33 of the bars 32 are held by a support 34 which, in turn, is connected to the shaft 5.

The procedure for the formation of a roll is as follows: in a position of the apparatus as is apparent for example from FIGS. 6 and 7, a slice 15 is conveyed up to the rolling facility so as to arrive, by its front end, between the bars 32. Now, the slideway 9, comprising the front ends of the rods 48, is withdrawn. The shaft 5 performs a few revolutions so that a roll is formed from the slice. The holding-down device 6, which is supported by a frame part 7 and is of slightly resilient design, presses against the outer periphery of the roll and ensures that a roll which is as compact as possible is obtained.

The rotating direction of the shaft 5 in this arrangement may be clockwise or counterclockwise. When the formation of the roll is finished, the shaft 5 with the bars 32 is withdrawn in the direction of the arrow 36, that is to say the bars 32 are removed from the interior of the roll. For this movement, it is advantageous to provide a stripper 27 which eliminates the possibility of the roll being taken along. It will be noted that this stripper 27 is shown only in the representation of FIGS. 7 and 8. The stripper 27 may, for example, be a ring which is axially immovably mounted in the case of a crosslike design, the stripper will rotate together with the bars.

When the bars 32 have been withdrawn, the formed roll 16 drops into one of the troughs 41 of the dish 18.

In FIG. 8 a modification of the invention is shown. Here, the rods 48 which form the slideway are replaced by a slideway 9 formed from one resilient bar or from a plurality of such resilient bars. These bars are supported by the crossmember 31. In the embodiment according to FIG. 8, it is not necessary to withdraw the slideway. Both in one rotating direction and in the other, the slideway, resting by its front ends on one of the bars 32, will yield.

The claims as filed at present with the application and subsequently are attempts at a formulation without prejudice to the achievement of wider protection.

The instances of referring back in the dependent claims indicate the development of the subject matter of the main claim by the features of the respective subclaim. However, these are not to be taken as constituting an abandonment of the achievement of independent, subject-matter protection for the features of the subclaims which refer back.

Features which until now have only been disclosed in the description may, in the course of the proceedings, be claimed as being essential to the invention, for example for delimitation from the prior art.

I claim:

1. An apparatus for the production of packages of sliced food product, said apparatus comprising:

a slicing machine for cutting product to be sliced into slices, conveyor means disposed adjacent said slicing machine for successively receiving slices from the slicing machine, a slice rolling facility located downstream of said conveyor means for receiving slices from said conveyor means, said rolling facility rolling slices into individual rolls, and a package located downstream of said rolling facility for receiving rolls of product from said slice rolling facility with at least some rolls located adjacent to one another, said slice rolling facility having at least one rotationally driven rolling mandrel for grasping a leading edge of a slice delivered from said conveyor means, said rolling mandrel including four equilistantly spaced parallel bars which are each held at one end by a support, the support and the bars being rotatable about an axis, at least some for the bars being a same distance from the axis, the sliced food product beign insertable, generally radially to the axis, between two neighbouring bars.

2. The apparatus as set forth in claim 1, wherein, for the conveyance of slices to the rolling mandrel, an endless conveying apparatus is provided and between a delivering end of the endless conveying apparatus and the bars of the rolling facility there is provided a slice supporting slideway.

3. The apparatus as set forth in claim 1, wherein a holding-down device is provided which, during the rolling operation, presses a slice against the bars rotating about said axis.

4. The apparatus as set forth in claim 1, wherein the package is arranged below the slice rolling facility which deposits rolls into the package.

5. An apparatus for the production of packages of sliced food product, said apparatus comprising:

conveyor means for successively receiving slices of food product, a slice rolling facility located downstream of said conveyor means for receiving slices from said conveyor means, said rolling facility rolling slices into individual rolls, and a package located downstream of said rolling facility for receiving rolls of product from said facility with at least some rolls located adjacent to one another, said slice rolling facility having at least one rotationally driven rolling mandrel which grasps a leading edge of a slice delivered from said conveyor means, said rolling mandrel including four equidistantly spaced parallel bars which are each held at one end by a support, the support and the bars being rotatable about an axis, at least some of the bars being a same distance from the axis, the sliced food product being insertable, generally radially to the axis, between two neighboring bars.

6. The apparatus as set forth in claim 5, wherein, for the conveyance of slices to the rolling mandrel, an endless conveying apparatus is provided and between a delivering end of the endless conveying apparatus and the bars of the rolling facility there is provided a slice supporting slideway.

7. The apparatus as set forth in claim 5, wherein a holding down device is provided which, during the rolling operation, presses a slice against the bars rotating about said axis.

8. The apparatus as set forth in claim 5, wherein the package is arranged below the rolling facility which deposits rolls in the package.

* * * * *